United States Patent [19]

Cook

[11] 4,434,900

[45] Mar. 6, 1984

[54] FREE STANDING ARTICLE DISPLAY APPARATUS

[75] Inventor: Melvin W. Cook, Dover, Ohio

[73] Assignee: Masonite Corporation, Chicago, Ill.

[21] Appl. No.: 460,887

[22] Filed: Jan. 25, 1983

[51] Int. Cl.[3] ..... A47B 47/00

[52] U.S. Cl. ..... 211/189; 52/282; 52/36; 248/222.4; 160/189

[58] Field of Search ..... 211/94, 189, 190; 312/111, 263; 248/222.4, 223.1; 52/282, 285, 281, 36, 38, 238; 160/135

[56] References Cited

U.S. PATENT DOCUMENTS

| | | | |
|---|---|---|---|
| 2,079,635 | 5/1937 | Sharp | 52/282 X |
| 2,383,068 | 8/1945 | MacLean | 248/222.4 X |
| 3,370,389 | 2/1968 | MacAluso | 52/282 X |
| 3,425,171 | 11/1971 | Propst et al. | 52/36 |
| 3,871,144 | 3/1975 | Rudin | 52/36 |
| 3,987,836 | 10/1976 | LeMay | 160/135 |
| 4,211,379 | 7/1980 | Morgan et al. | 52/36 X |

*Primary Examiner*—Ramon S. Britts
*Assistant Examiner*—Blair M. Johnson
*Attorney, Agent, or Firm*—Mason, Kolehmainen, Rathburn & Wyss

[57] ABSTRACT

A free standing article display apparatus includes detachable panel and post combinations which may be rapidly assembled and disassembled to provide a wide variety of forms and configurations for accommodating and matching the area and motif of a display floor or sales area.

20 Claims, 14 Drawing Figures

FIG. 1
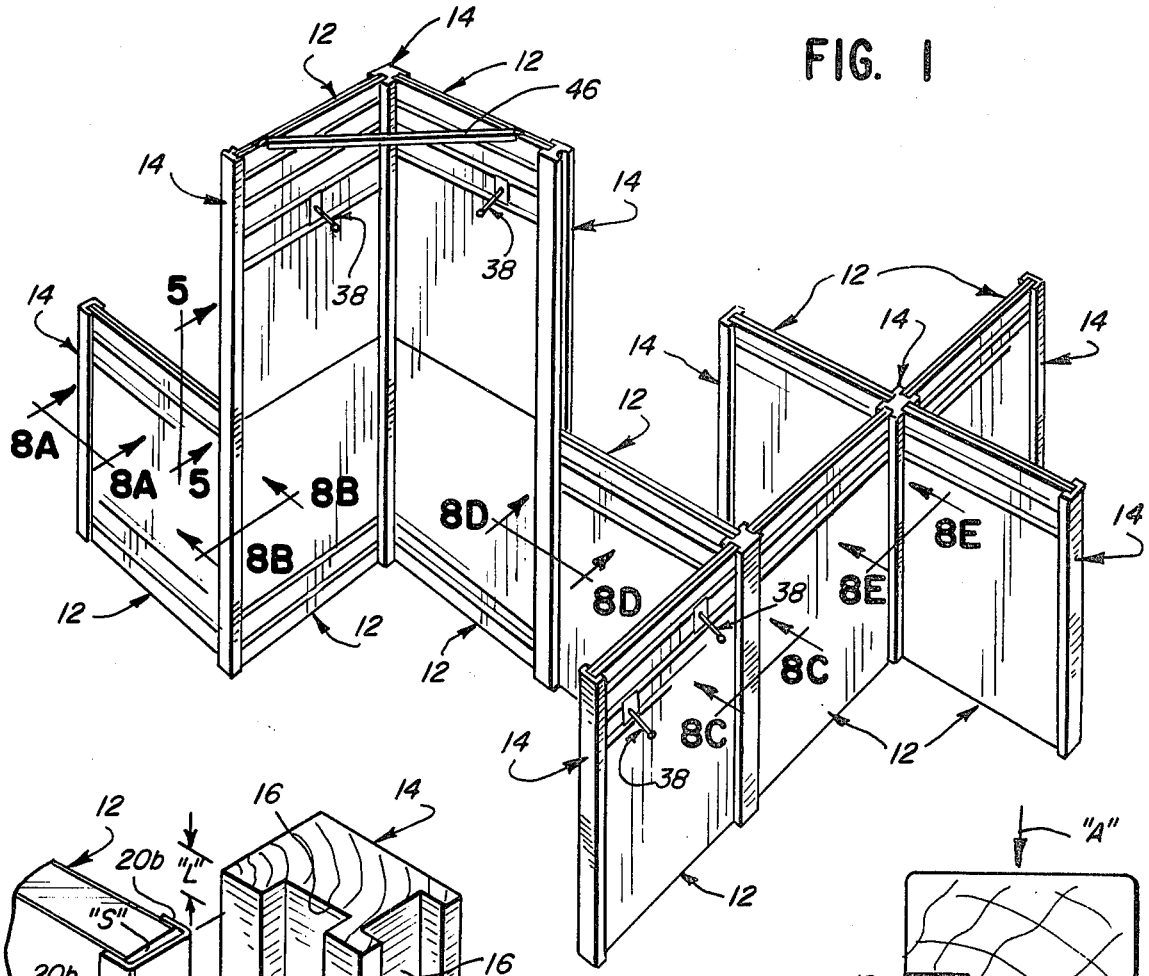
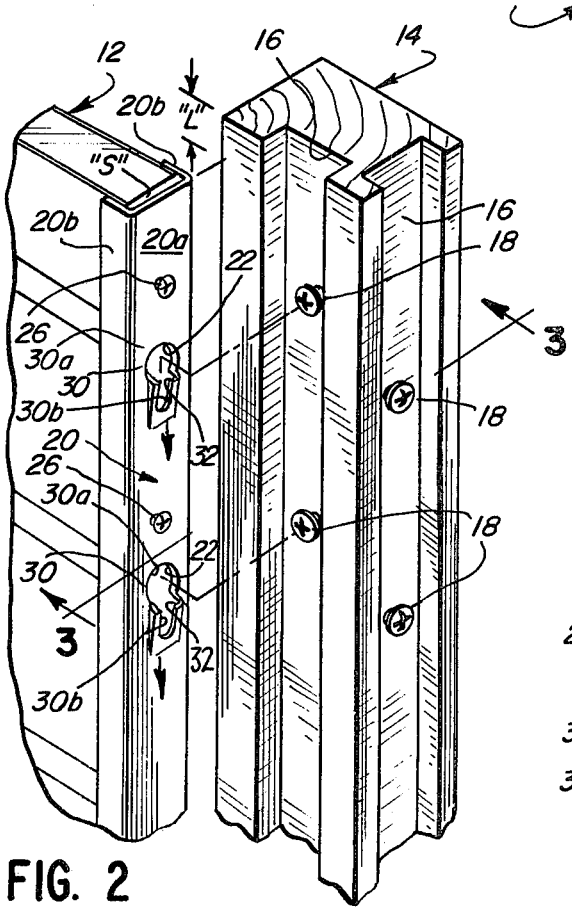
FIG. 2
FIG. 3
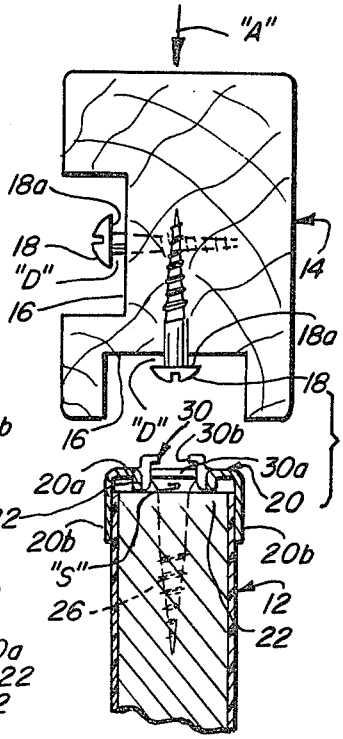
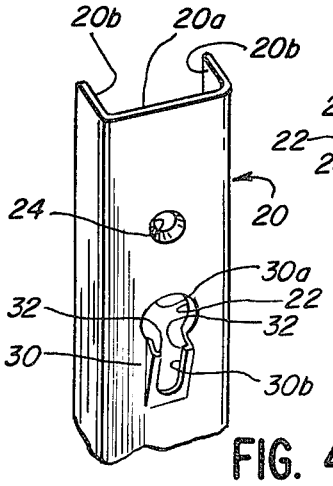
FIG. 4

FIG. 4a
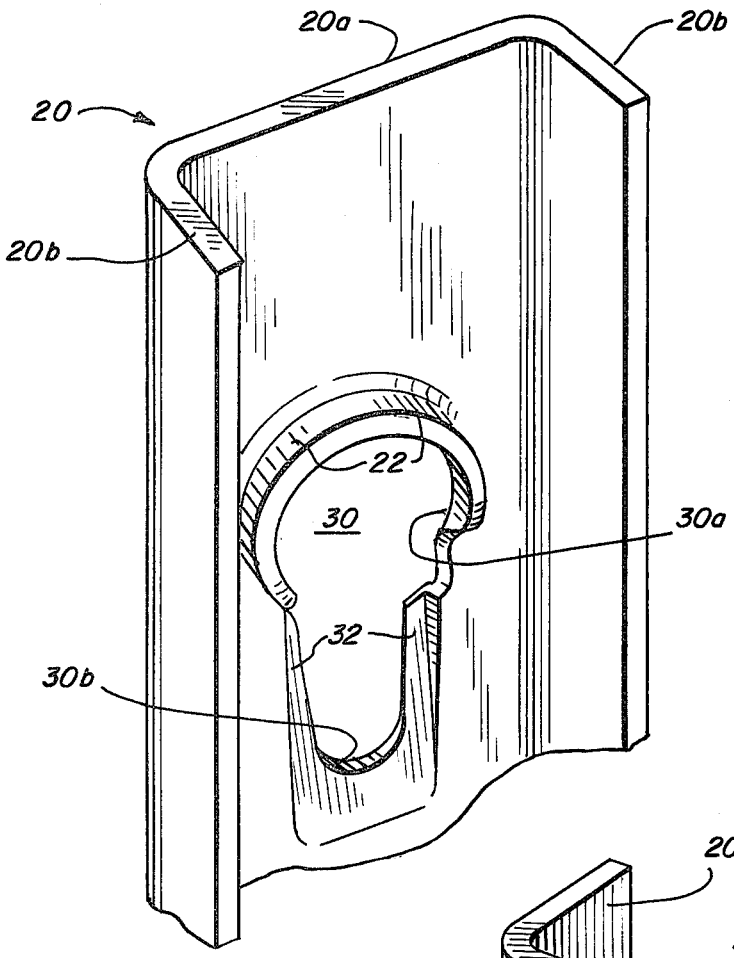
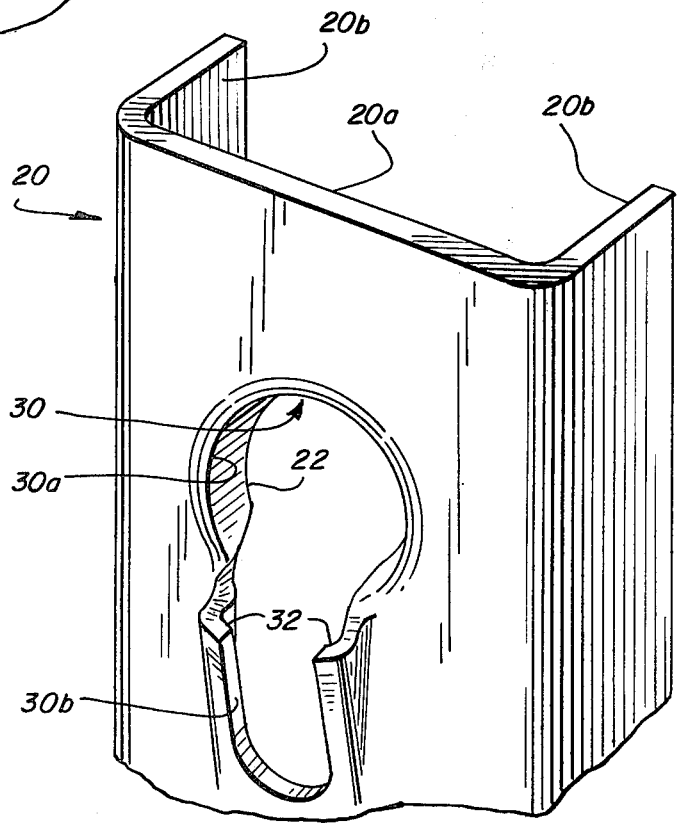
FIG. 4b

FIG. 5
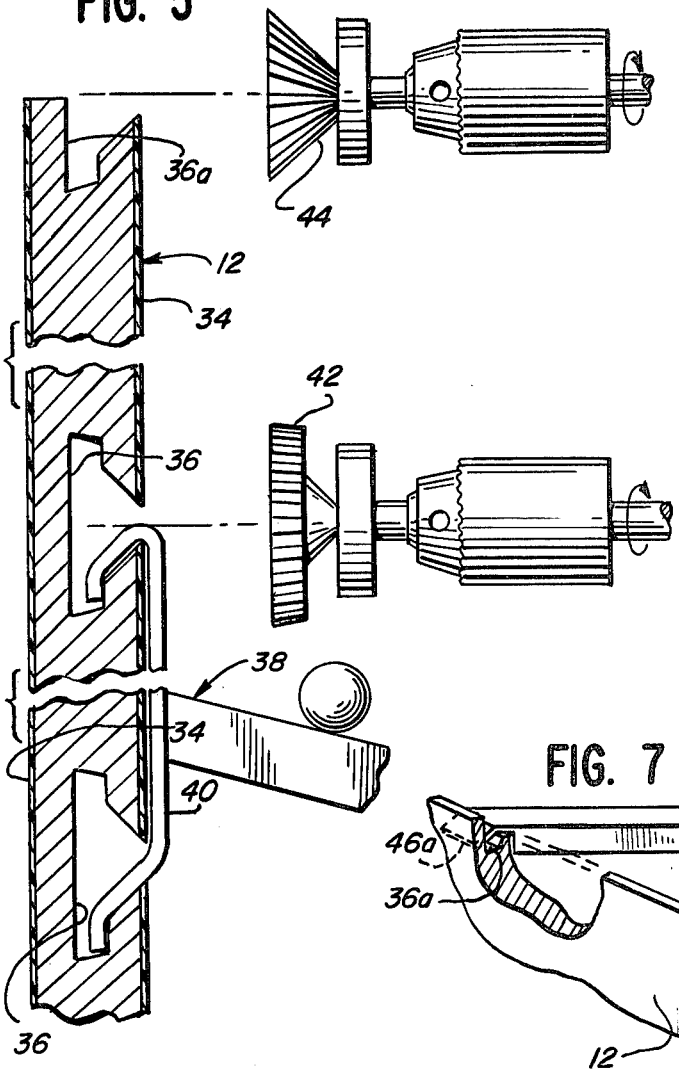
FIG. 6
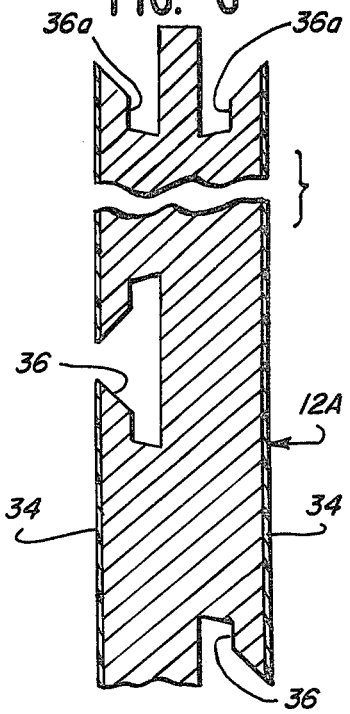
FIG. 7
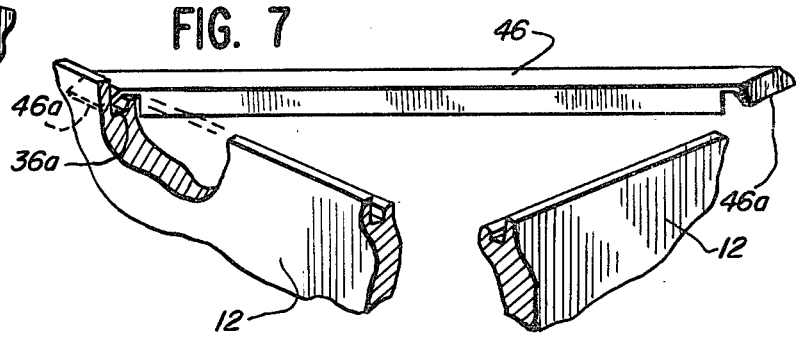
FIG. 8A
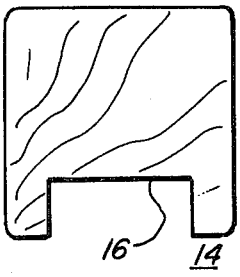
FIG. 8B
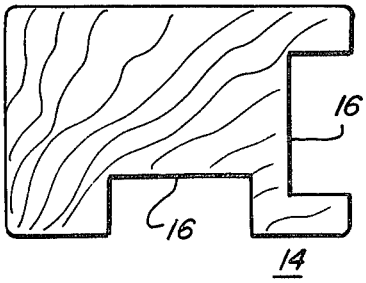
FIG. 8C
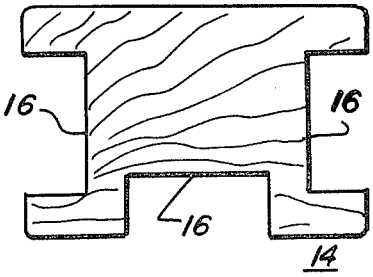
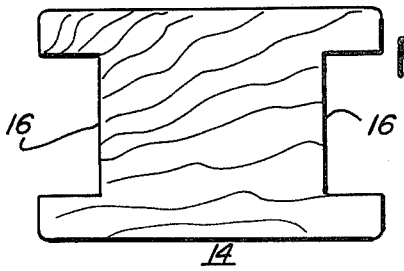
FIG. 8D
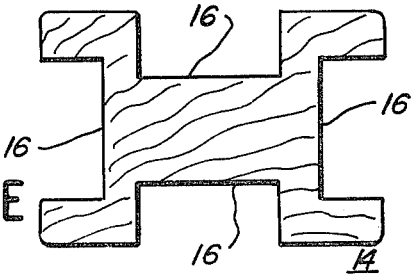
FIG. 8E

FREE STANDING ARTICLE DISPLAY APPARATUS

BACKGROUND OF THE INVENTION

The present invention relates to a new and improved free standing vertical display apparatus adapted for use in commercial establishments for the display of a wide variety of items. The display apparatus is universal and may be assembled to take a wide variety of shape and form configurations to accommodate a particular size and motif in a display area or showroom. In addition, the display apparatus in accordance with the invention is adapted to be easily and rapidly assembled and disassembled and yet still provide a function and aesthetically appealing means for displaying a wide variety of articles.

Accordingly, it is an important object of the present invention to provide a new and unique, free standing article display apparatus and more particularly, an article dispay system of the character described which may be easily and rapidly assembled and disassembled and which is universal in nature and adaptable to provide a wide variety of shapes and configurations for accommodating a wide variety of display areas and showroom motifs.

Yet another object of the present invention is to provide a new and improved free standing article display system which is relatively low in cost, universal in application, and aesthetically appealing.

BRIEF SUMMARY OF THE INVENTION

The foregoing and other objects and advantages of the present invention are accomplished in a new and unique, free standing, article display system which comprises display panels having upstanding edges and means for securing articles for display on the face of the panel. An edge channel is mounted along an upstanding edge and includes a web spaced apart outwardly therefrom and a pair of flanges which engage opposite faces of the panel. A spacer is provided forming an open space between the panel edge and the web of the channel which is provided with apertures for receiving fasteners for securing the channel in place on the panel edges.

Detachable upstanding support posts are provided for the panel edges and the posts have a longitudinally extending recess in at least one face for receiving the edge channel of an adjacent display panel. Headed fasteners are carried in the recess of the posts and the heads are adapted to pass through keyholes in the channel web during assembly of the posts on the panel edge. The fastener heads are engaged with stop surfaces along a narrow slot portion of the keyholes to secure the channel web on a panel in interlocking relation with a post. The interlock is accomplished by sliding the posts longitudinally along the panel edge while the heads are positioned in the space between the panel edge and channel web until the shanks of the fasteners are engaged against the narrow end of the keyholes.

The free standing display apparatus may include a plurality of panels arranged in a variety of configurations relative to one another and interconnected with one or more of the upstanding posts to form and build a free standing display apparatus in a desired display configuration. Several panels may be stacked vertically and connected to a common vertical post and several panels may be arranged to extend outwardly in different directions from several faces of a common or unitary post to provide a wide variety of shape configurations for the display apparatus so as to match the layout desired in a showroom or sales area.

The posts and panels may be readily disassembled by sliding the posts longitudinally relative to the panel edges until the headed fasteners are aligned with the large portion of the keyholes; and then the panels and posts are separated or pulled apart.

BRIEF DESCRIPTION OF THE DRAWINGS

For a better understanding of the present invention, reference should be had to the following description, taken in conjunction with the drawings, in which:

FIG. 1 is a perspective view of a new and improved free standing, article display apparatus in assembled form constructed in accordance with the features of the present invention;

FIG. 2 is an exploded perspective view of a display panel and post combination illustrated in disassembled or detached condition;

FIG. 3 is a fragmentary, enlarged, cross-sectional view taken substantially along line 3—3 of FIG. 2;

FIG. 4*a* is a fragmentary, greatly enlarged perspective view of an inside web face of an edge channel in accordance with the invention;

FIG. 4*b* is fragmentary, greatly enlarged perspective view of an outside web face of an edge channel in accordance with the invention;

FIG. 4 is a fragmentary, perspective view of an edge channel constructed in accordance with the features of the present invention;

FIG. 5 is a fragmentary enlarged, cross-sectional view taken substantially along line 5—5 of FIG. 1;

FIG. 6 is a cross-sectional view similar to FIG. 5, but illustrating a panel of greater thickness having grooves on both faces thereof;

FIG. 7 is a fragmentary cross-sectional view illustrating a support bracket extending between a pair of panels at right angles to one another; and FIGS. 8A, 8B, 8C, 8D and 8E are transverse cross-sectional views of several types of support posts of the apparatus taken substantially along lines 8A, 8B, 8C, 8D and 8E of FIG. 1.

DETAILED DESCRIPTION OF A PREFERRED EMBODIMENT OF THE INVENTION

Referring now more particularly to the drawings, in FIG. 1 is illustrated a new and improved, free standing article display apparatus constructed in accordance with the features of the present invention and referred to generally by the reference numeral 10. The display apparatus 10 includes a plurality of upstanding display panels 12 assembled together in a free standing structural configuration as shown in combination with a plurality of vertically upstanding support posts 14. The posts are preferably formed of wood and have several types of transverse, cross-section such as shown in FIGS. 3, 8A, 8B, 8C, 8D and 8E. Each post includes a longitudinally extending shallow recess 16 in at least one side face adapted to receive an edge portion of a panel 12 assembled therewith to form a universal, free standing structure of the type shown in FIG. 1.

As best shown in FIGS. 2 and 3, along the center line of the base of each recess 16, there is provided at spaced longitudinal intervals, a plurality of headed screws 18 having threaded shanks extending into the body of the post. As illustrated in FIG. 2, when more than one recess 16 is provided on several faces of a post 14, the screws 18 on adjacent faces are staggered longitudinally so that the shanks do not intersect within the body of the post as shown in FIG. 3.

Preferably, the screws 18 are round headed and are uniformly spaced along the longitudinal center axis of each recess. Each screw has an annular, radially extending underside or stop surface 18*a* on the screw head which is spaced outwardly of the adjacent bottom surface of the recess 16 in order to provide a clearance distance "D" or space that is large enough to accommodate the thickness of a web 20*a* of an elongated metal edge channel 20. The channels 20 are secured along opposite upstanding edges of the panels 12 and each channel includes a pair of opposite edge flanges 20*b* overlapping marginal edge portions and corners on opposite side faces of the panels, as best shown in FIGS. 2 and 3.

The web 20*a* and channel flanges 20*b* intersect at rounded corners along the upstanding edge portions of the display panels 12 and the channels are dimensioned so that the distance dimension between opposite outside surfaces of the flanges is slightly less than the transverse width of the recesses 16 in the posts 14. The channels 20 are permanently attached to the opposite edges of the panels 12 by a plurality of screws 26 and the screw heads are seated in frustroconical counter-sink apertures 24 provided at spaced intervals in the webs 20*a* of the channels (FIG. 4).

In accordance with the present invention, the webs 20*a* of the edge channels are mounted along the panel edges in spaced apart relationship to provide an open space "S" between the inside face of the channel web and the outer edge face of the attached panel 12 in order to accommodate the heads of the fasteners 18 when the panels and posts are interlocked together as will be described hereinafter.

The space "S" is established by means of curved walls 22 (FIGS. 4*a* and 4*b*) which are struck from the body of the channel web when generally keyhole shaped apertures 30 are formed in a punch press operation. The apertures 30 are adapted for accommodating the heads of the screw fasteners 18 used for securing a post 14 to the edge channel 20 on the upstanding opposite edge of a display panel 12.

In accordance with the present invention, a plurality of keyhole shaped slots 30 are punched in the channel webs 20*a* at longitudinally spaced intervals along the center line spaced from an adjacent frustoconical counter-sink apertures 24. Each keyhole has a rounded, large diameter head portion 30*a* dimensioned to permit the heads of the screws 18 to pass directly through the web in a transverse direction into the space "S" between the web and adjacent panel edge. The keyholes include a narrow, longitudinal slot portion or tail 30*b* rounded at the opposite end and joined to the large diameter head portion 30*a*. The narrow slot or tail is dimensioned with a width just wide enough to accommodate the shanks of the screw fasteners 18. Opposite sides 32 of each tail slot are slopped outwardly of the outside face of the channel web from the lower end of the tail of the slot (FIGS. 2, 4, and 4*a*) and these sloped surfaces function to pull the screw head in tighter toward the panel edge as the screw shank approaches the end of the tail slot. This wedging action provides a tight fit between the post and panel edge so that the overall display apparatus 10 is a strong rigid structure when assembled. The stop surfaces 32 directly engage the surface 18*a* of a screw head 18 seated in the space "S" in order to positively and firmly interlock a panel and post combination together.

Referring now to FIG. 3, when it is desired to interlock a post 14 with a channel 20 along the upstanding edge of a panel 12, the post is aligned with the recess 16 opposite to and directly facing the channel web 20*a*. The relative position of the post with respect to the adjacent channel web is adjusted (FIG. 2) so that the heads of the screws 18 may pass directly through the large diameter head portions 30*a* of the respective keyholes 30 into the space "S" upon transverse movement (Arrow "A", FIG. 3) of the panel edge into the recess 16 of the post. After the head surfaces 18*a* are seated between the web 20*a* and panel edge in the space "S", relative longitudinal movement between the post and panel is initiated and the undersurface 18*a* of the screw heads are slidably engaged against the sloping stop surfaces 32 on opposite sides of the narrow slots or tails 30*b*. Movement (Distance "L" FIG. 2) is continued until the screw shanks seat against the rounded ends of the slot tails. When this is accomplished, the ends of the post and panel are even or flush and the post and panel are positively interlocked together with the panel extending outwardly from the shallow recess 16 in a side face of the post.

As illustrated in FIGS. 1 and 8, dependent upon the particular type of post 14 that is utilized, one or more panels 12 may be positively interlocked with a single vertical post in rapid and easy fashion to provide a universal free standing display apparatus to accommodate almost any type of display area or showroom. As illustrated in FIG. 1, a pair of panels 12, for example, 4'×4' in nominal size, may be secured in vertically stacked relation to a single post 14 to provide a structure that is nominally 8' high. A pair of panels may be interlocked together to lie in common plane forming a horizontal row utilizing a post of the type shown in FIG. 8D. The post of FIG. 8B provides a corner post joining two panels at right angles to each other, the post of FIG. 8C provides a corner post joining three panels and the post of FIG. 8E provides a cross post for joining four panels together. The post of FIG. 8A provides an outer free edge support for any of the panels of the structure 10 not connected with other panels.

When it is desirable to disassemble a post and panel combinations in order to knock down a display apparatus 10 or to reposition panels thereof, a post 14 along the edge of a panel is moved longitudinally in a direction opposite to that used during assembly for a distance "L" (FIG. 2) until the headed fasteners 18 are directly aligned with the larger diameter head portions 30*a* of the keyhole slots 30. The curved wall 22 at the large end 30*a* of each keyhole 30, prevents or stops the screw heads from moving past a directly aligned position and positively prevents the screw head surfaces 18*a* from engaging the inside face of the channel web around the large end 30*a* of the keyholes. This insures that the post may then be withdrawn outwardly away from the panel edge without interference and the post and panel are thus easily disassembled, but may be reassembled together again at a later time. The curved stop walls 22 struck from the channel webs at the large diameter end of the keyholes thus serve a twofold purpose of establishing a space "S" to accomodate the screw heads and additionally preventing the screw heads from hanging up at the large end of the key hole slots during dissassembly.

The location of the key hole slots 30 is symmetrical with respect to the center of each channel 20 so that identical channels may be used on opposite edges of each panel. For example, the channel on a right hand panel edge is oriented with the large diameter heads 30*a* of the keyholes above the tails 30*b* and the channel on the opposite or left hand edge is inverted with the slots heads 30*a* below the tails 30*b*. This permits a universal spacing of the screws 18 in the recesses 16 of the posts 14 so that a post can be assembled on either edge of panel 12 without relocation of screws.

Disassembled panels and posts are easily handled and stacked, and the edge channels 20 protect the corners and edges of the panels to provide a convenient means for stacking a number of panels without fear of damage. Because the headed fasteners 18 are mounted within the recesses 16 on the posts, the posts may be stacked easily without interference and there is little or no chance of the fasteners causing cuts or scrapes on clothing or limbs when the posts and display panels are handled during assembly, disassembly, transfer or storage.

Referring now to FIGS. 5 and 6, the article display panels 12 and 12A are preferably formed of wood composite material such as hardboard, fiberboard, flake board, chip board, plywood, etc. and these materials are relatively low in cost and relatively strong and stable. The panels 12 may be nominally ¾" thick and may be provided with surface coverings 34 of a decorative and protective type formed of vinyl or other plastic or metallic materials. If only one side of a panel will be exposed for display, the decorative surface covering 34 on a back face of the panel may be omitted entirely if desired, but generally because of the free standing nature of the display apparatus, it is usually desirable to have decorative surface coverings on both sides or faces of each panel 12 or 12A.

In accordance with the present invention, the panels are provided with a plurality of spaced parallel horizontally extending grooves 36 having a modified T-shaped, transverse, cross-section as illustrated in FIGS. 5 and 6. These grooves accommodate metal or plastic hangers 38 having enlarged base portions 40 which engage internal wall surfaces of the grooves to hold the hangers on the panels with the hanger arms extending outwardly and normally transverse to the face or surface of a panel. The grooves 36 are preferably formed with appropriately shaped milling cutters 42 and 44 and the grooves generally extend completely across the face of the panels between opposite edges but may be of shorter length if desired.

Referring to FIG. 6, the panel 12A is of somewhat greater thickness (nominal 1⅛") and requires that the shallow recesses in the matching posts 16 be somewhat wider in order to accommodate the increased panel thickness and with corresponding wider channels 20. The thicker panels 12A are provided with horizontal grooves in both opposite faces so as to accommodate article hangers 38 extending outwardly from opposite sides.

Grooves 36*a* along upper edges and lower edges of panels 12 and 12A may comprise only half the cross-section of the regular grooves 36 intermediate the upper and lower edges. These upper edge grooves are adapted to receive depending tongues 46*a* formed at a 45° angle relative to the longitudinal axis of an elongated stiffened brace 46 having a generally channel-shaped, transverse cross-section. The stiffening brackets or braces may be utilized when necessary to insure that panels at right hand angles to one another are securely maintained in this desired angular relationship. The depending tongues of the braces 46*a* are adapted to project downwardly into the upper edge grooves 36*a* to provide and secure the interlocking engagement between the braces and the panel edges.

From the foregoing, it will be seen that the new and unique free standing article display apparatus in accordance with the present invention is universal in nature and is capable of providing an aesthetically pleasing article display apparatus for almost any size, configuration or motif of a display room or sales area. The post-/panel combinations may be readily assembled and disassembled in rapid fashion, and provide an extremely desirable system for creative merchandising and display of a wide variety of articles. The article display apparatus is economical, universal in application, and an aesthetically appealing sales aid.

Although the present invention has been described with reference to several illustrated embodiments thereof, it should be understood that numerous other modifications and embodiments can be made by those skilled in the art that will fall within the spirit and scope of the principles of this invention.

What is claimed as new and desired to be secured by Letters Patent is:

1. A free standing article display apparatus, comprising:

a display panel having an edge and means for securing an article for display adjacent a face of said panel;

an edge channel mounted along said edge of said panel including a web spaced outwardly apart from said panel edge and a pair of flanges engagable with opposite faces of said panel;

spacer means for providing an open space between said panel edge and said channel web, said web including at least one aperture therein for receiving a fastener;

an upstanding post having a longitudinally extending recess in one face thereof for receiving said edge channel on said display panel; and at least one fastener extending between said recess of said post and said web of said channel for securing said post along said edge of said panel, said fastener including head means adapted to fit within said space and engage said channel web in interlocking relation.

2. The display apparatus of claim 1 wherein said spacer means comprises wall means struck from said web projecting outwardly toward said one panel edge.

3. The display apparatus of claim 1 wherein said aperture in said channel web is key-hole shaped and is dimensioned to pass said head means of said fastener in a large portion thereof and provide an edge abutment for holding engagement with said head means along a small portion thereof.

4. The display apparatus of claim 3 wherein said small portion of said key-hole aperture is spaced longitudinally of said large portion along said web whereby relative longitudinal movement between said post and channel after initial passage of said head means into said space through said large portion is effective to establish said interlocking relation with said head means adjacent said small portion of said key-hole aperture.

5. The display apparatus of claim 1 wherein said fastener comprises a screw having a shank engaged in said post with said head means including a stop surface spaced from an adjacent surface of said post by a distance greater than the thickness of said channel web.

6. The display apparatus of claim 3 wherein said spacer means comprises wall means struck from said web around at least a segment of said large portion of said keyhole shaped aperture.

7. The display apparatus of claim 3 wherein said small portion of said key hole shaped slot includes opposite sides sloped outwardly of an outer face of said channel web for guiding said head means toward an end of said small portion of said slot to tightly secure said post and panel together.

8. The display apparatus of claim 1 wherein said post includes a plurality of longitudinal recesses on different sides for receiving an edge channel of a display panel joined to said post.

9. The display apparatus of claim 8 wherein said recesses are on opposite sides of said post.

10. The display apparatus of claim 8 wherein said recesses are on adjacent intersecting sides of said post.

11. The display apparatus of claim 8 wherein said recess is provided on each side of said post.

12. The display apparatus of claim 8 wherein said recesses are provided on opposite and adjacent intersecting sides of said post.

13. The display apparatus of claim 8 including at least one of said fasteners in each recess, said fasteners in different recesses being staggered longitudinally of one another.

14. The display apparatus of claim 8 including a plurality of said panels having an edge channel mounted thereon and engaged in a recess of said post.

15. The display apparatus of claim 14 including brace means extending between said panels for securing the same in selected angular relation outwardly away from said post.

16. The display apparatus of claim 1 including a plurality of said panels having an edge channel mounted thereon and engaged in stacked relationship in said recess of said post, each panel being secured by at least one of said fasteners with said post.

17. The display apparatus of claim 1 wherein said means for securing an article for display includes at least one groove formed in said panel face.

18. The display apparatus of claim 1 wherein said means for securing an article for display includes at least one groove on opposite faces of said panel.

19. The display apparatus of claim 17 including a plurality of said grooves in horizontal parallel relation at vertically spaced positions on said panel.

20. The display apparatus of claim 17 wherein said groove is outwardly open on said one face and includes a wide section inwardly thereof for receiving an article support element.

* * * * *